US009716929B1

(12) United States Patent
Lippitt

(10) Patent No.: US 9,716,929 B1
(45) Date of Patent: Jul. 25, 2017

(54) RELATIVE POSITIONING OF SPEAKERS

(71) Applicant: Bose Corporation, Framingham, MA (US)

(72) Inventor: Benjamin Lippitt, Worcester, MA (US)

(73) Assignee: Bose Corporation, Framingham, MA (US)

( * ) Notice: Subject to any disclaimer, the term of this patent is extended or adjusted under 35 U.S.C. 154(b) by 17 days.

(21) Appl. No.: 14/988,211

(22) Filed: Jan. 5, 2016

(51) Int. Cl.
*H04R 1/02* (2006.01)

(52) U.S. Cl.
CPC ..... *H04R 1/026* (2013.01); *H04R 2201/025* (2013.01)

(58) Field of Classification Search
CPC ..... H04R 1/026; H04R 2201/025
See application file for complete search history.

(56) References Cited

U.S. PATENT DOCUMENTS

| | | | |
|---|---|---|---|
| 5,163,167 | A | 11/1992 | Heil |
| 5,602,366 | A | 2/1997 | Whelan et al. |
| 6,536,554 | B2 | 3/2003 | Andrews et al. |
| 6,640,924 | B2 | 11/2003 | Messner |
| 6,652,046 | B2 | 11/2003 | Christner |
| 7,036,781 | B1 | 5/2006 | Bothe |
| 7,261,180 | B1 | 8/2007 | Faranda et al. |
| 7,298,860 | B2 | 11/2007 | Engebretson et al. |
| 7,328,769 | B1 | 2/2008 | Adamson |
| 7,516,932 | B2 | 4/2009 | Engebretson et al. |
| 7,634,100 | B2 | 12/2009 | Monitto et al. |
| 7,693,296 | B2 | 4/2010 | Monitto et al. |
| 7,967,103 | B2 | 6/2011 | Bothe |
| 7,997,552 | B2 | 8/2011 | Engebretson et al. |
| 8,130,996 | B2 | 3/2012 | Kling et al. |
| 8,165,334 | B2 | 4/2012 | Iwayama |
| 8,170,263 | B2 | 5/2012 | Engebretson et al. |
| D692,863 | S | 11/2013 | Givre et al. |
| D692,864 | S | 11/2013 | Givre et al. |
| D692,865 | S | 11/2013 | Givre et al. |
| 8,590,666 | B2 | 11/2013 | Adamson et al. |
| 8,600,097 | B2 | 12/2013 | McGhee et al. |
| D698,336 | S | 1/2014 | Givre et al. |
| 8,807,270 | B2 | 8/2014 | Givre |
| 8,842,867 | B2 | 9/2014 | Bothe |

(Continued)

FOREIGN PATENT DOCUMENTS

| | | | |
|---|---|---|---|
| CN | 2927574 | Y | 7/2007 |
| CN | 103037284 | A | 4/2013 |

(Continued)

*Primary Examiner* — Muhammad N Edun

(57) ABSTRACT

An apparatus for positioning two speakers relative to each other includes a link member with a first securing through hole and a first plurality of adjusting through holes. A first anchor plate which can be secured to a first speaker has a second securing through hole. A first pin is able to be passed through the first and second securing through holes to secure the link member and the first anchor plate together at a back, central location of the speaker. A second anchor plate which can be secured to a second speaker has a second plurality of adjusting through holes. A second pin is able to be passed through one of the first plurality of adjusting through holes and one of the second plurality of adjusting through holes to secure the link member and the second anchor plate together.

21 Claims, 2 Drawing Sheets

(56) References Cited

U.S. PATENT DOCUMENTS

| | | | | |
|---|---|---|---|---|
| 2003/0231782 | A1* | 12/2003 | Engebretson | H04R 1/026 381/182 |
| 2005/0232455 | A1* | 10/2005 | Monitto | H04R 1/026 381/335 |
| 2006/0256976 | A1 | 11/2006 | House | |
| 2008/0170729 | A1 | 7/2008 | Lissaman et al. | |
| 2012/0189420 | A1 | 7/2012 | Kemper et al. | |
| 2013/0208936 | A1 | 8/2013 | McGhee et al. | |
| 2014/0205132 | A1 | 7/2014 | Spillmann et al. | |
| 2014/0301580 | A1* | 10/2014 | Andrews | H04R 1/025 381/182 |
| 2014/0307907 | A1 | 10/2014 | Takeuchi et al. | |
| 2014/0353074 | A1 | 12/2014 | Bridge et al. | |

FOREIGN PATENT DOCUMENTS

| | | | |
|---|---|---|---|
| DE | 102012110648 | A1 | 5/2014 |
| GB | 2512690 | A | 10/2014 |

* cited by examiner

RELATIVE POSITIONING OF SPEAKERS

BACKGROUND

U.S. Pat. No. 7,298,860 discloses a system for enabling the assembly and suspension of a plurality of loudspeakers in a line array where the splay angle between the adjacent speakers can be adjusted and rigidly maintained. The line array system utilizes rigging frames that allow for the coupling and supporting of the loudspeakers through the use of adjustable hinge bars. The rigging frames and adjustable hinge bars together form and rigidly maintain the splay angles between adjacent loudspeakers and correspondingly the curvature of the line array speaker assembly.

An issue with this disclosure is that two pins 714 must be used to adjust the splay angle between adjacent line array speakers (col. 7, lines 18-30). Having to use two pins to adjust the splay angle increases the cost and complexity of this system.

U.S. Pat. No. 8,130,996 discloses loud speakers which are equipped with, on their back sides, a mount for connectors with which the individual loud speakers can be connected to one another. The mount comprises two legs that are attached to the back side of the loud speaker box and enclose a channel in which the connector is displaceably movable. At its one end the mount has a row of holes for receiving a pin that extends through a hole on one end of a connector belonging to the adjacent loud speaker box and has at its other end a manually actuated spring-loaded snap-in pin. The snap-in pin is insertable through another hole disposed in front of the other end of the connector. One guide unit on each side of the snap-in pin limits the channel and are arranged perpendicular to the direction of movement of the connector and form guides for the connector.

An issue with this disclosure is that the connector 4 only has a single hole 13 that is designed and intended to be aligned with one of the holes 9 for securing the connector 4 to the mount in which the holes 9 are located. Note that the blind hole 16 in connector 4 is designed and intended to only be used when the loud speaker is put in the transport position after the loud speaker box group has been disassembled. As such, a total of nine holes (one hole 13 and eight holes 9) are used to obtain eight different positions between two speakers. If, for example, three holes 13 and three holes 9 were used instead, a total of nine different positions between the two speakers could be obtained with only six total holes.

U.S. Pat. No. 7,634,100 discloses a side frame for a loudspeaker rigging system has links associated with the frame structure for linking together the corners of the frame structures of vertically adjacent side frames. The links associated with each side frame structure include a pivot link and splay adjustment link, each of which has a top extended end and a base end with a seating edge. Guide channels, which are located in the top corner regions of the frame structure to receive the base ends of a pivot link and splay adjustment link associated with a vertically adjacent side frame, have seating surfaces that conform to the seating edges at the base ends of the pivot and splay adjustment link. When base ends of these links seat in the guide channels, pin holes in the base end of the links self-align with pin holes in the corners of the frame structure for easy insertion locking pins. The extended end of the splay adjustment link further includes at least two, and preferably an array of pin holes which can selectively be matched with one pin hole within a row of pin holes in a bottom corner region of the side frame to permit adjustments of the splay angle over a range of angles. Suitably, two rows of pin holes are provided in the top extended end of the splay adjustment link to permit multiple and incrementally small splay angle adjustments.

This arrangement requires a side frame and splay adjustment link on each side of each speaker which adds greatly to the cost and complexity of this loudspeaker rigging system. It also requires holes spaced out perpendicular to the primary direction of adjustment, which adds greatly to the space required.

SUMMARY

In one aspect, an apparatus for positioning two speakers relative to each other includes a link member with a first securing through hole and a first plurality of adjusting through holes. A first anchor plate which can be secured to a first speaker has a second securing through hole. A first pin is able to be passed through the first and second securing through holes to secure the link member and the first anchor plate together at a back, central location of the speaker. A second anchor plate which can be secured to a second speaker has a second plurality of adjusting through holes. A second pin is able to be passed through one of the first plurality of adjusting through holes and one of the second plurality of adjusting through holes to secure the link member and the second anchor plate together. The first and second anchor plates are located external to their respective speakers.

Implementations may include one of the following features, or any combination thereof. The first plurality of adjusting through holes are located a first distance from each other. The second plurality of adjusting through holes are located a second distance from each other. The first and second distances are different from each other. The first and second distances are set so that a splay angle between the two speakers can be adjusted in about one degree increments. The first plurality of adjusting through holes are arranged in a substantially straight line. The second plurality of adjusting through holes are arranged in a substantially straight line. The first and second plurality of adjusting through holes are substantially parallel to a general direction of adjustment. The link member and second anchor plate can be moved relative to each other such that each of the first plurality of adjusting through holes can be aligned with a subset of the second plurality of adjusting through holes non-simultaneously. When the link member and the first anchor plate are secured together, the link member can rotate relative to the first anchor plate. When the link member and the second anchor plate are secured together the link member can rotate relative to the second anchor plate, allowing the link member to make the connection to the first anchor plate as the assembly angle changes.

In another aspect, a speaker system includes first and second speakers, and a link member with a first securing through hole and a first plurality of adjusting through holes. A first anchor plate can be secured to the first speaker and has a second securing through hole. A first pin is able to be passed through the first and second securing through holes to secure the link member and the first anchor plate together at a back, central location of the speaker. A second anchor plate can be secured to the second speaker and has a second plurality of adjusting through holes. A second pin is able to be passed through one of the first plurality of adjusting through holes and one of the second plurality of adjusting through holes to secure the link member and the second anchor plate together. Only the first and second plurality of adjusting through holes and the second pin are used to adjust positioning between the first and second speakers. All of the first plurality of adjusting through holes are designed and intended to be used to position the speakers relative to each other.

Implementations may include one of the above features, or any combination thereof.

A method of positioning first and second speakers relative to each other includes providing a link member with a first securing through hole and a first plurality of adjusting through holes. A first pin is passed through the first securing through hole and a second securing through hole in a first anchor plate which is secured to the first speaker at a back, central location on the first speaker to secure the link member and the first anchor plate together. A second pin is passed through one of the first plurality of adjusting through holes and one of a second plurality of adjusting through holes in a second anchor plate which is secured to the second speaker to secure the link member and the second anchor plate together. Only the first and second plurality of adjusting through holes and the second pin are used to adjust positioning between the first and second speakers. All of the first plurality of adjusting through holes are designed and intended to be used to position the speakers relative to each other.

Implementations may include one of the above features, or any combination thereof.

All examples and features mentioned above can be combined in any technically possible way. Other features and advantages will be apparent from the description and the claims.

DESCRIPTION

The description below discloses an apparatus and method for joining two speakers together and setting a splay angle between the two speakers in a simple and cost effective way.

Figure 1:
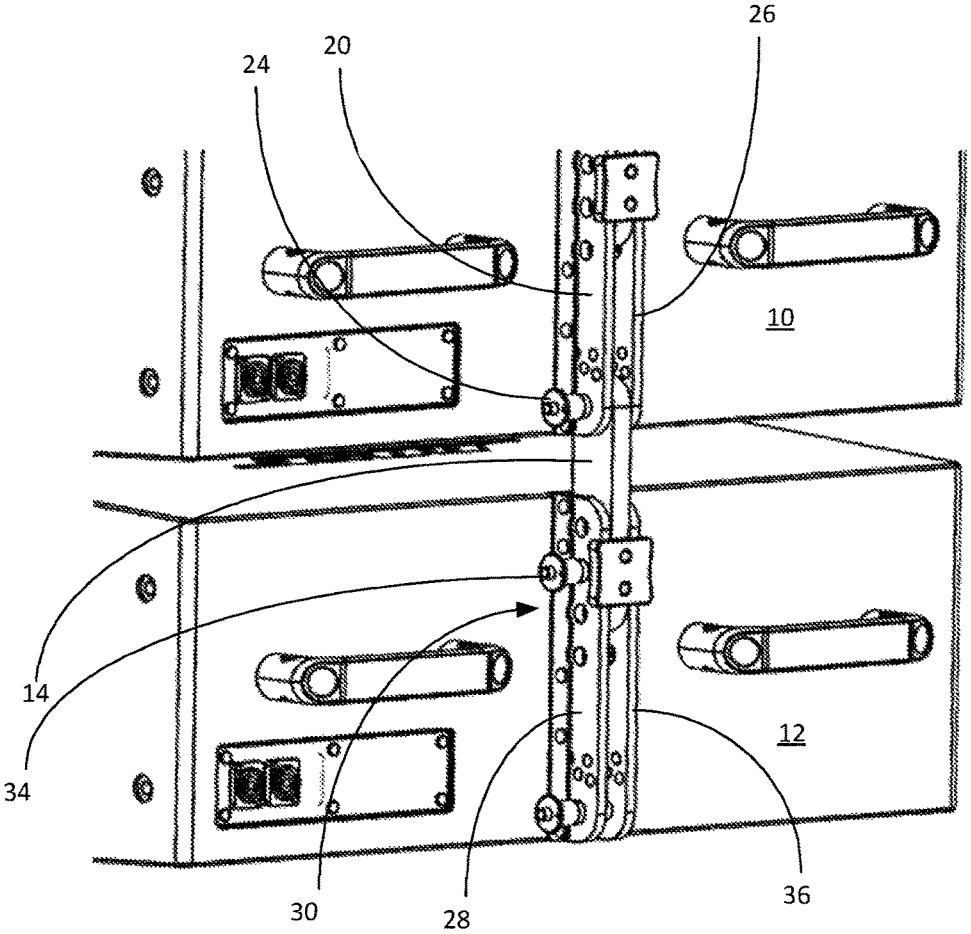
FIG. 1 shows a rear perspective view of portions of two speakers connected together.
Figure 2:
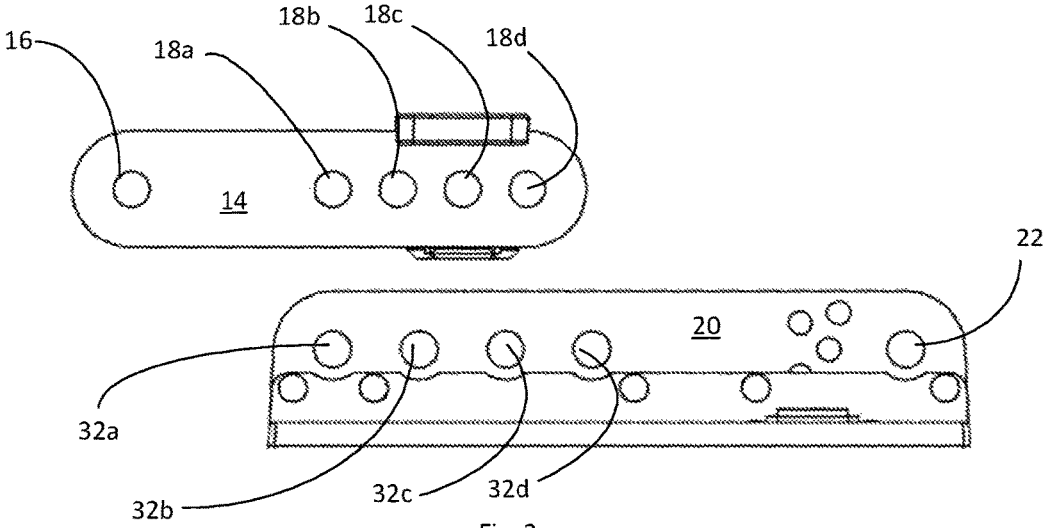
FIG. 2 is a plan view of two components used to connect the speakers of FIG. 1.

Referring to FIGS. 1 and 2, an apparatus for positioning two speakers 10 and 12 relative to each other and securing them together includes a link member 14 with a securing through hole 16 and a plurality of adjusting through holes 18*a-d*. An anchor plate 20 is secured to a back surface of the speaker 10 and has a second securing through hole 22. The anchor plate 20 shown in FIG. 2 is representative of all anchor plates described in this description. A pin 24 is passed through the securing through holes 16 and 22 to secure the link member 14 and the first anchor plate 20 together at a back, central location of the speaker 10. The pin 24 also passes through another securing hole in an anchor plate 26 that is substantially the same as anchor plate 20. This arrangement allows the link member 14 to rotate relative to the anchor plates 20 and 26.

Another anchor plate 28 is secured to the speaker 12 and has a plurality of adjusting through holes 30*a-d*. Similar through holes 32*a-d* are identified in plate 20 of FIG. 2. A second pin 34 is passed through one of the plurality of adjusting through holes 18*a-d* and one of the plurality of adjusting through holes 30 to secure the link member 14 and the anchor plate 28 together. The pin 34 also passes through an adjusting through hole in another anchor plate 36 that is substantially the same as anchor plate 20. All of the holes described above are sized to receive the pins 24 and 34 which are preferably 12 mm quick pins. In this example the adjusting holes 18*a-d* are arranged in a substantially straight line as are the adjusting holes 30 and 32*a-d*. In a storage position the link member 14 can be completely contained between the two plates 28 and 36

All of the plurality of adjusting through holes 18*a-d* are designed and intended to be used to position the speakers relative to each other. To adjust the position between the speakers, only a single pin needs to be removed, the speaker positioning is then adjusted, and that pin is reinserted into the anchor plate 28 and link 14. This makes adjusting the speaker position simple and less costly. The first and second anchor plates 20 and 28 are located external to their respective speakers 10 and 12. The link member 14, the anchor plates 20, 26, 28 and 36, and the pins 24 and 34 are preferably made of steel. The speakers 10 and 12 are also connected at their front sides so that the speakers can rotate relative to each other about an axis that is substantially parallel to at least one front face of the speakers. The first and second plurality of adjusting through holes are substantially parallel to a general direction of adjustment of the positioning of the speakers.

With reference to FIG. 2, the first plurality of adjusting through holes 18*a-d* are each located about 22 mm from an adjacent through hole 18*a-d*. The second plurality of adjusting through holes 32*a-d* are each located about 29 mm from an adjacent through holes 32*a-d*. This arrangement provides a 7 mm adjustment increment which in this example allows six different speaker positions, corresponding to splay angles (described further below) of 0 thru 5 degrees in 1 degree increments. In this example the holes 18*b-d* are each capable of being aligned with two of the holes 30 (non-simultaneously). This arrangement allows up to seven different relative positions between the speakers 10 and 12 (only six are used in this example).

Figure 3:
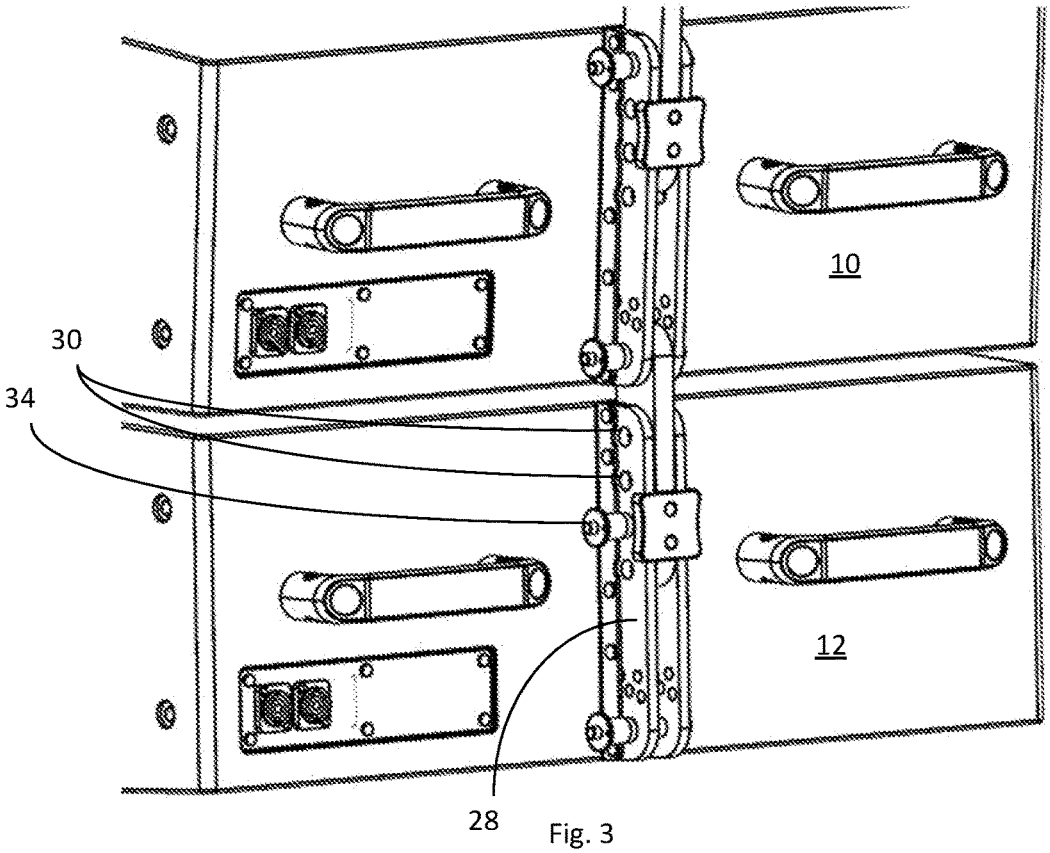
FIGS. 3 and 4 show the speakers of FIG. 1 in respective different relative positions to each other.
Figure 4:
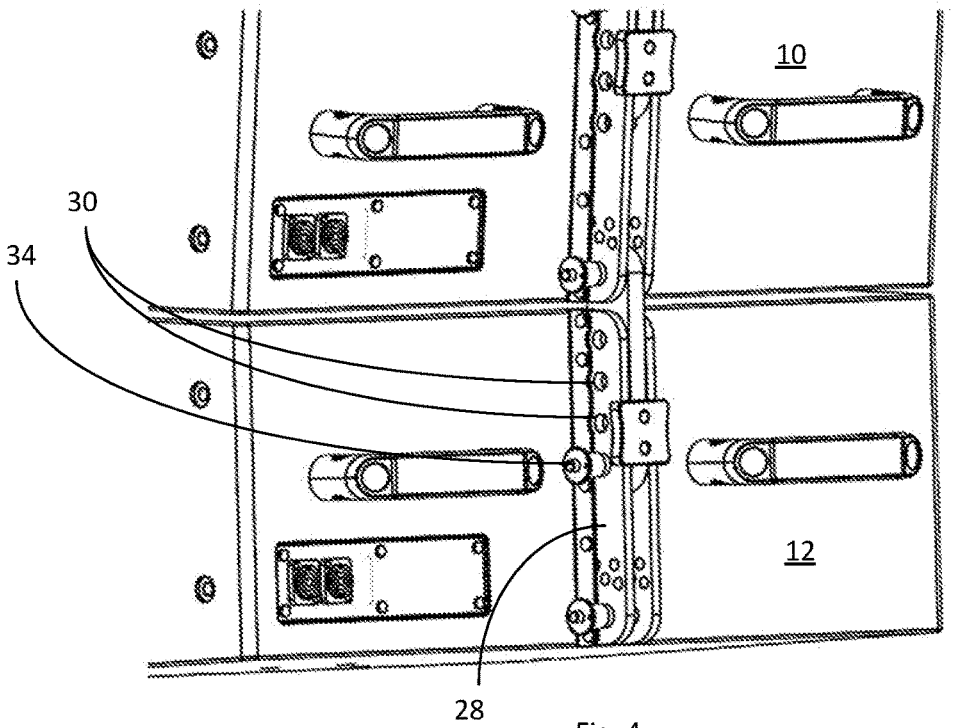

In FIG. 1 the pin 34 has been inserted through one of the holes 18 in the link member 14 and one of the holes 30 in the plate 28. This has set a splay angle of the speakers at zero degrees. The splay angle is the angle between a plane that contains a front face of one of the speakers, and a similar front face on the other speaker. In FIG. 3 the pin 34 has been inserted through one of the holes 18 in the link member 14 and another one of the holes 30 in the plate 28 to set the splay angle of the speakers at 4 degrees. In FIG. 4 the pin 34 has been inserted through one of the holes 18 in the link member 14 and yet another one of the holes 30 in the plate 28 to set the splay angle of the speakers at 5 degrees. The pins 24 and 34 can be inserted in either order, although it is preferable that the pin 34 be inserted first to set the splay angle, and then the pin 24 is inserted to secure the speaker 12 to the speaker 10. When the link member 14 and the second anchor plate 28 are secured together, the link member can rotate relative to the second anchor plate, allowing the link member to make the connection to the first anchor plate 20 as the splay angle changes.

The hole combinations between the adjusting holes in the link member 14 and the plate 30 (shown as plate 20 in the chart below) is as follows:

| Splay Angle | Link Hole | Mount Hole |
|---|---|---|
| 5 | 18d | 32d |
| 4 | 18c | 32c |

-continued

| Splay Angle | Link Hole | Mount Hole |
|---|---|---|
| 3 | 18b | 32b |
| 2 | 18a | 32a |
| 1 | 18d | 32c |
| 0 | 18c | 32b |
| Unused Pattern Fails | 18b | 32a |

A number of implementations have been described. Nevertheless, it will be understood that additional modifications may be made without departing from the scope of the inventive concepts described herein, and, accordingly, other embodiments are within the scope of the following claims.

What is claimed is:

1. An apparatus for positioning two speakers relative to each other, comprising:

a link member with a first securing through hole and a first plurality of adjusting through holes;

a first anchor plate which can be secured to a first speaker and having a second securing through hole, a first pin being able to be passed through the first and second securing through holes to secure the link member and the first anchor plate together at a back, central location of the speaker; and a second anchor plate which can be secured to a second speaker and having a second plurality of adjusting through holes, a second pin being able to be passed through one of the first plurality of adjusting through holes and one of the second plurality of adjusting through holes to secure the link member and the second anchor plate together, the first and second anchor plates being located external to their respective speakers.

2. The apparatus of claim 1, wherein the first plurality of adjusting through holes are located a first distance from each other, and the second plurality of adjusting through holes are located a second distance from each other, the first and second distances being different from each other.

3. The apparatus of claim 2, wherein the first and second distances are set so that a splay angle between the two speakers can be adjusted in about one degree increments.

4. The apparatus of claim 1, wherein the first plurality of adjusting through holes are arranged in a substantially straight line.

5. The apparatus of claim 1, wherein the second plurality of adjusting through holes are arranged in a substantially straight line.

6. The apparatus of claim 1, wherein the link member and second anchor plate can be moved relative to each other such that each of the first plurality of adjusting through holes can be aligned with two of the second plurality of adjusting through holes non-simultaneously.

7. The apparatus of claim 1, wherein when the link member and the first anchor plate are secured together, the link member can rotate relative to the first anchor plate.

8. A speaker system, comprising:

first and second speakers;

a link member with a first securing through hole and a first plurality of adjusting through holes;

a first anchor plate which can be secured to the first speaker and having a second securing through hole, a first pin being able to be passed through the first and second securing through holes to secure the link member and the first anchor plate together at a back, central location of the speaker; and a second anchor plate which can be secured to the second speaker and having a second plurality of adjusting through holes, a second pin being able to be passed through one of the first plurality of adjusting through holes and one of the second plurality of adjusting through holes to secure the link member and the second anchor plate together, whereby only the first and second plurality of adjusting through holes and the second pin are used to adjust positioning between the first and second speakers, all of the first plurality of adjusting through holes being designed and intended to be used to position the speakers relative to each other.

9. The apparatus of claim 8, wherein the first plurality of adjusting through holes are located a first distance from each other, and the second plurality of adjusting through holes are located a second distance from each other, the first and second distances being different from each other.

10. The apparatus of claim 9, wherein the first and second distances are set so that a splay angle between the two speakers can be adjusted in about one degree increments.

11. The apparatus of claim 8, wherein the first plurality of adjusting through holes are arranged in a substantially straight line.

12. The apparatus of claim 8, wherein the second plurality of adjusting through holes are arranged in a substantially straight line.

13. The apparatus of claim 8, wherein the link member and second anchor plate can be moved relative to each other such that each of the first plurality of adjusting through holes can be aligned with two of the second plurality of adjusting through holes non-simultaneously.

14. The apparatus of claim 8, wherein when the link member and the first anchor plate are secured together, the link member can rotate relative to the first anchor plate.

15. A method of positioning first and second speakers relative to each other, comprising the steps of:

providing a link member with a first securing through hole and a first plurality of adjusting through holes;

passing a first pin through the first securing through hole and a second securing through hole in a first anchor plate which is secured to the first speaker at a back, central location on the first speaker to secure the link member and the first anchor plate together; and passing a second pin through one of the first plurality of adjusting through holes and one of a second plurality of adjusting through holes in a second anchor plate which is secured to the second speaker to secure the link member and the second anchor plate together, whereby only the first and second plurality of adjusting through holes and the second pin are used to adjust positioning between the first and second speakers, all of the first plurality of adjusting through holes being designed and intended to be used to position the speakers relative to each other.

16. The method of claim 15, wherein the first plurality of adjusting through holes are located a first distance from each other, and the second plurality of adjusting through holes are located a second distance from each other, the first and second distances being different from each other.

17. The method of claim 16, wherein the first and second distances are set so that a splay angle between the two speakers can be adjusted in about one degree increments.

18. The method of claim 15, wherein the first plurality of adjusting through holes are arranged in a substantially straight line.

19. The method of claim 15, wherein the second plurality of adjusting through holes are arranged in a substantially straight line.

20. The method of claim 15, wherein the link member and second anchor plate can be moved relative to each other such that each of the first plurality of adjusting through holes can be aligned with two of the second plurality of adjusting through holes non-simultaneously.

21. The method of claim 15, wherein when the link member and the first anchor plate are secured together, the link member can rotate relative to the first anchor plate.

* * * * *